US005309164A

United States Patent [19]

Dienes et al.

[11] Patent Number: 5,309,164

[45] Date of Patent: May 3, 1994

[54] PATCH-TYPE MICROWAVE ANTENNA HAVING WIDE BANDWIDTH AND LOW CROSS-POL

[75] Inventors: Geza Dienes, Claremont; William W. Seal, Covina, both of Calif.; Russell W. Dearnley, Viewbank, Australia

[73] Assignee: Andrew Corporation, Orland Park, Ill.

[21] Appl. No.: 965,338

[22] Filed: Oct. 23, 1992

Related U.S. Application Data

[63] Continuation of Ser. No. 867,410, Apr. 13, 1992, abandoned.

[51] Int. Cl.[5] ..... H01Q 1/38

[52] U.S. Cl. ..... 343/700 MS; 343/841

[58] Field of Search ..... 343/700 MS, 767, 770, 343/841; H01Q 1/38

[56] References Cited

U.S. PATENT DOCUMENTS

| | | | |
|---|---|---|---|
| 4,125,839 | 11/1978 | Kaloi | 343/700 MS |
| 4,291,311 | 9/1981 | Kaloi | 343/700 MS |
| 4,370,657 | 1/1983 | Kaloi | 343/700 MS |
| 4,686,535 | 8/1987 | Lalezari | 343/700 MS |
| 4,692,769 | 9/1987 | Gegan | 343/700 MS |
| 5,039,994 | 8/1991 | Wash et al. | 343/841 |

FOREIGN PATENT DOCUMENTS

| | | | |
|---|---|---|---|
| 0484241 | 5/1992 | European Pat. Off. . | |
| 0006503 | 1/1987 | Japan | 343/700 MS |
| 2067842 | 7/1981 | United Kingdom . | |
| 2251340 | 7/1992 | United Kingdom . | |

*Primary Examiner*—Donald Hajec
*Assistant Examiner*—Tan Ho
*Attorney, Agent, or Firm*—Arnold White & Durkee

[57] ABSTRACT

A patch antenna having a dielectric substrate; a plurality of radiating patches on the substrate, each radiating patch including a plurality of spaced slots to suppress the radiation of energy that is polarized in a direction transverse to the direction of the desired polarization; a ground plane supported by the substrate in generally parallel and spaced relationship to the patches; a distribution network for transmitting and receiving signals within the antenna; and a plurality of probes within the substrate for coupling the radiating patches and the distribution network, one end of each probe being connected to the distribution network, and the other end of the probe being coupled to one of the radiating patches. In a preferred embodiment, a plurality of chokes are connected to the ground plane and associated with the patches to further suppress the radiation of energy having undesired polarization.

15 Claims, 4 Drawing Sheets

PATCH-TYPE MICROWAVE ANTENNA HAVING WIDE BANDWIDTH AND LOW CROSS-POL

CROSS REFERENCE TO RELATED APPLICATION

This application is a continuation of pending application Ser. No. 07/867,410, filed Apr. 13, 1992, now abandoned.

FIELD OF THE INVENTION

The present invention relates generally to patch-type microwave antennas, and particularly to an improved patch-type antenna which has a wide bandwidth and low cross-pol so that it can be used as a base-station antenna for cellular telephone systems and other applications.

BACKGROUND OF THE INVENTION

Cellular telephone systems today transmit and receive both analog and digital signals. One example of an accepted analog system is the American Advanced Mobile Phone System (AMPS), which operates in the 824 to 894 MHz frequency band, and one example of an accepted digital system is the Groupe Speciale Mobile System (GSM), which operates in the 890 to 960 MHz frequency band. To be usable in both frequency bands, a base-station antenna must have wide operational bandwidth with a low VSWR across the entire bandwidth. For example, the AMPS and GSM frequency bands require a VSWR of less than 1.5 over a bandwidth of approximately 16%.

The base stations in a cellular telephone system typically use antennas mounted on 30-meter towers to communicate with mobile units over a range of up to 3 kilometers. Both sector-coverage and omni-directional-coverage antennas are employed, depending upon the cell geography and the traffic density. Sector-coverage antennas have traditionally been of the co-linear, corner-reflector type, can be physically large and are often considered objectionable from an environmental standpoint. As many as twelve corner-reflector antennas may be used on a single tower platform. These antennas often end up physically downtilted to minimize cell overshoot, and the resultant untidy appearance compounds the environmental problems.

Because of the need to communicate with mobile units having antennas installed vertically on vehicles, cellular systems typically use signals which are vertically polarized. It is, therefore, desirable to minimize the amount of energy transmitted with unwanted horizontal polarization ("cross-pol") because the transmission of such signals merely reduces the efficiency of the system.

SUMMARY AND OBJECTS OF THE INVENTION

It is a primary object of the present invention to provide an improved microwave antenna which has a gain, return loss and bandwidth suitable for use in a base-station of a cellular telephone system, and which also has a low cross-pol level. In this connection, a related object of the invention is to provide a single antenna which has a bandwidth and other characteristics that will accommodate the transmit and receive functions of both analog and digital cellular telephone systems.

It is another important object of this invention to provide an improved microwave antenna which can be arrayed in a planar array and excited in relative phase and amplitude to provide the desired electrical beam downtilt and sidelobe levels.

A further significant object of this invention is to provide such an improved microwave antenna which can be accommodated in a compact assembly which is relatively small and aesthetically pleasing.

Still another object of this invention is to provide an improved microwave antenna which will readily provide the requisite angular sector coverage, in both azimuth and elevation, for any type of cellular telephone system.

A still further object of the invention is to provide such an improved microwave antenna which avoids spurious radiation by the feed system for the radiating patches.

It is another object of the invention to provide an improved microwave antenna which can be efficiently and economically manufactured.

Other objects and advantages of the invention will be apparent from the following detailed description and the accompanying drawings.

In accordance with the present invention, the foregoing objectives are realized by providing a patch antenna comprising a dielectric substrate, and a plurality of radiating patches on the substrate, each radiating patch including a plurality of spaced slots to suppress the radiation of energy that is polarized in a direction transverse to the direction of the desired polarization. The antenna also includes a distribution network for transmitting and receiving signals within the antenna, and a plurality of probes within the substrate for coupling the radiating patches and the distribution network, one end of each probe being connected to the distribution network and the other end of each probe being coupled to one of the radiating patches. To further suppress undesired cross-polarization, a plurality of chokes may be connected to the ground plane for the distribution network.

DESCRIPTION OF THE PREFERRED EMBODIMENTS

Figure 1:
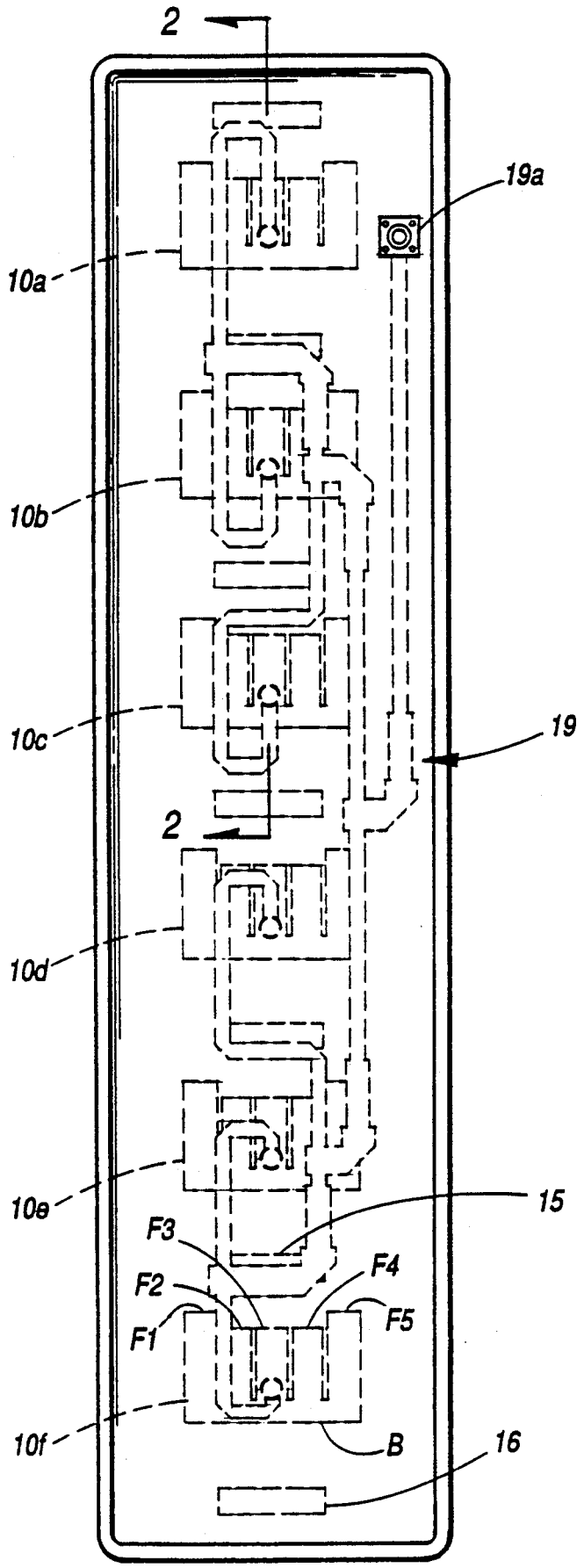
FIG. 1 is an elevation view of a patch-type microwave antenna embodying the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Figure 2:
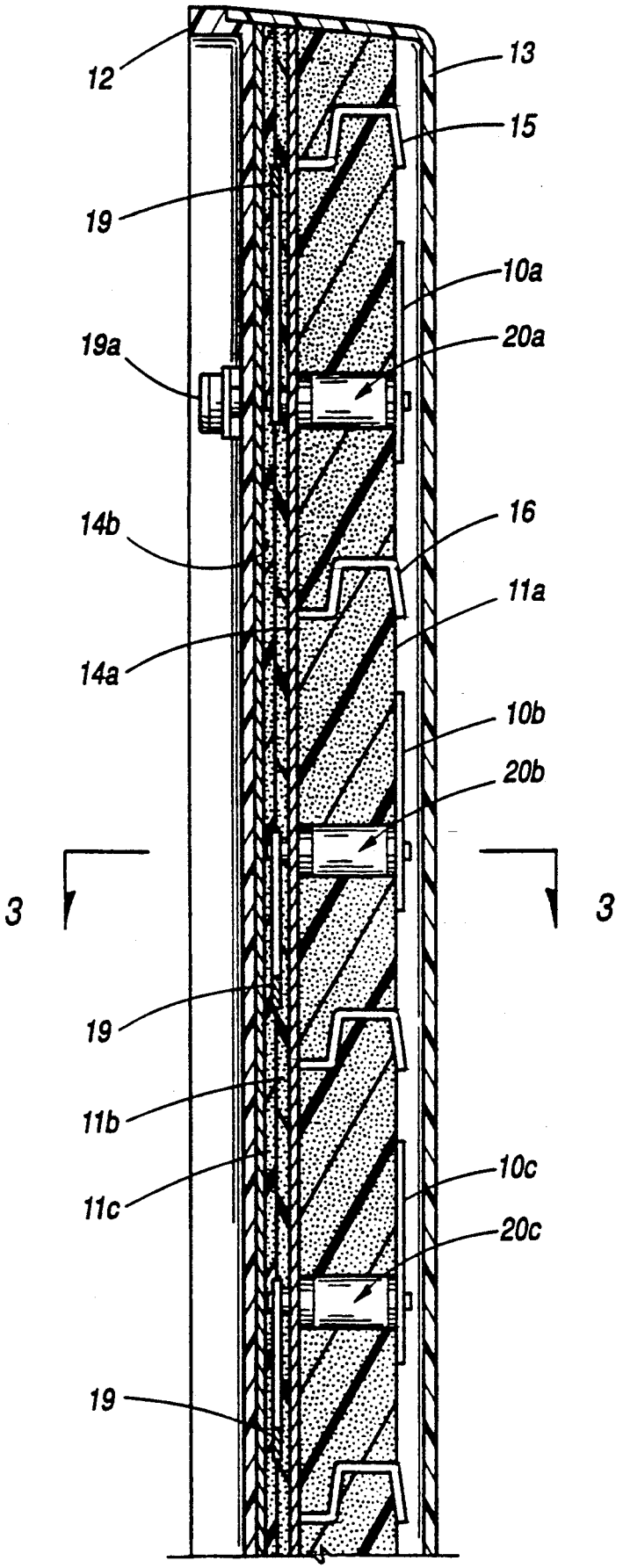
FIG. 2 is an enlarged section taken generally along line 2—2 in FIG. 1.

Turning now to the drawings and referring first to FIGS. 1 and 2, there is shown a patch-type antenna comprising a stacked array of six linearly polarized radiating patch elements 10*a*–10*f* mounted on the front surface of a substrate 11 made of a rigid, closed-cell, dielectric foam. The substrate 11 is enclosed by the combination of a rigid fiberglass rear panel 12 and a protective fiberglass radome 13. The radome 13 is bonded to the periphery of the panel 12 and extends around the front surface of the substrate 11 and the patch elements 10*a*–10*f* mounted thereon. This encapsulation of the antenna within the sealed enclosure formed by the rear panel 12 and the radome 13 protects the antenna from ambient water and moisture. Any necessary backing or mounting hardware may be easily attached to the rear panel 12.

The use of the same material for the rear panel 12 and the radome 13 avoids differential expansion problems, and also facilitates the bonding together of these two members. When the common material for these two members is a fiberglass sheet molding compound, it also facilitates the production of a fairly complicated shape, easily and cheaply. It is also strong and remains stable when exposed to ultra-violet radiation.

To permit the patch elements 10*a*–10*f* to be stacked in a vertical array of first-order-mode radiating elements, the substrate 11 is elongated in the vertical direction. The patch elements 10*a*–10*f* are mounted on the front surface of layer 11*a* of the substrate 11 at equally spaced intervals, as can be seen in FIG. 1, with the feed points for the six patch elements in vertical alignment with each other. Thus, the six patch elements 10*a*–10*f* are all located in a common vertical plane. This vertically stacked array of patch elements provides the angular sector coverage, in both azimuth and elevation, required in cellular telephone systems. In general the azimuth (horizontal) beamwidth varies inversely as the width of the antenna is increased.

In accordance with one aspect of the present invention, each of the radiating patch elements includes a plurality of slots to suppress the radiation of energy that is polarized in a direction transverse to the direction of the desired polarization. In the illustrative embodiment, each of the radiating patch elements 10*a*–10*f* includes four parallel vertical slots which divide the patch into five vertical strips or fingers F1–F5. The slots terminate short of the top edge of the patch, thereby forming a base portion B from which the fingers F1–F5 depend.

A probe 20 is connected to each patch element 10 at about the center of the base portion B. The slotted configuration of the radiating patches forces the currents in the patches to flow in one predominant direction, which in turn suppresses the radiation of energy having an undesired polarization. The major portion of the energy is radiated with the desired polarization, such as the vertical polarization typically desired in a cellular communication system. Consequently, the gain of the antenna is much better than that of antennas which produce excessive amounts of cross-polarized radiation. In addition, the antenna maintains the desired wide bandwidth, e.g., it is capable of operating over a band of 820 to 960 MHz with low levels of cross polarization across the entire band.

The fingers of the radiating patch elements 10 may also be used to control the beamwidth produced by the antenna. For example, the beamwidth may be reduced by making the two end fingers F1 and F5 outboard of the endmost slots larger than the intermediate fingers F2–F4 in the inboard portion of the patch. In general, the end fingers F1 and F5 should be about 15 to 20% longer than the intermediate fingers F2–F4. Increasing the end fingers by this amount can reduce the beamwidth from about 80° to about 40°–60°.

Although the illustrative embodiment of the invention has four slots in each radiating patch element 10, it will be understood that different numbers of slots may be utilized within the scope of this invention. In general, it has been found that four slots represent an optimum design. Fewer slots do not reduce the cross-pol sufficiently for most applications, and the use of more than four slots does not reduce the cross-pol much more than four slots.

The overall dimensions of each patch element are not narrowly critical, but in general it is preferred that the width of the patch element be between 0.25λ and 0.75λ at the center frequency of the operating bandwidth, and that the height of the patch element be between 0.075λ and 0.25λ. For the 820–960 MHz band mentioned above, a suitable size for each patch element is 180 mm. by 110 mm.

A pair of ground planes 14*a* and 14*b*, slightly spaced apart from each other, are located in the rear portion of the substrate 11. Specifically, the ground plane 14*a* is located between layers 11*a* and 11*b* of the substrate 11, and the ground plane 14*b* is located between layer 11*c* and the front surface of the rigid panel 12. Both ground planes 14*a* and 14*b* are parallel to the front surface of the substrate 11 and, therefore, parallel to the radiating patch elements 10*a*–10*f*. Each ground plane 14*a* and 14*b* is preferably made of a single thin (e.g., 1 mm.) aluminum plate.

Figure 3:
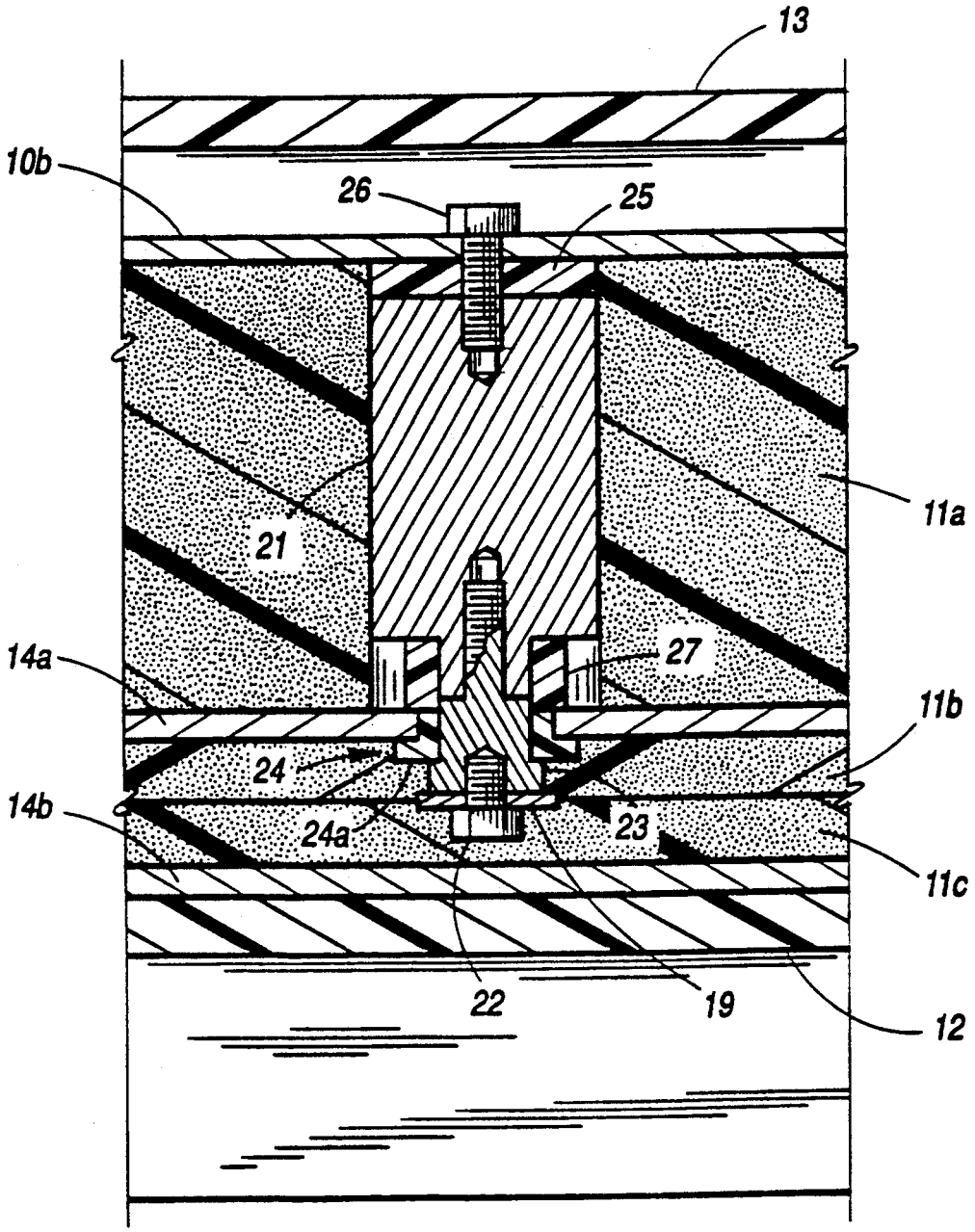
FIG. 3 is an enlarged section taken generally along line 3—3 in FIG. 2.

In accordance with another aspect of the invention, chokes are provided on the ground plane to suppress ground-plane currents that produce radiation of energy that is polarized in a direction transverse to the direction of the desired polarization. These chokes are preferably located on opposite sides of each radiating patch. In the illustrative embodiment of FIGS. 1–3, a pair of chokes 15 and 16 are located adjacent the top and bottom edges of the patch 10*a*. The impedances provided by these chokes 15 and 16 tend to block ground-plane currents which would produce radiation of unwanted polarization, and yet the chokes do not reduce the broad bandwidth of the antenna.

Figure 4:
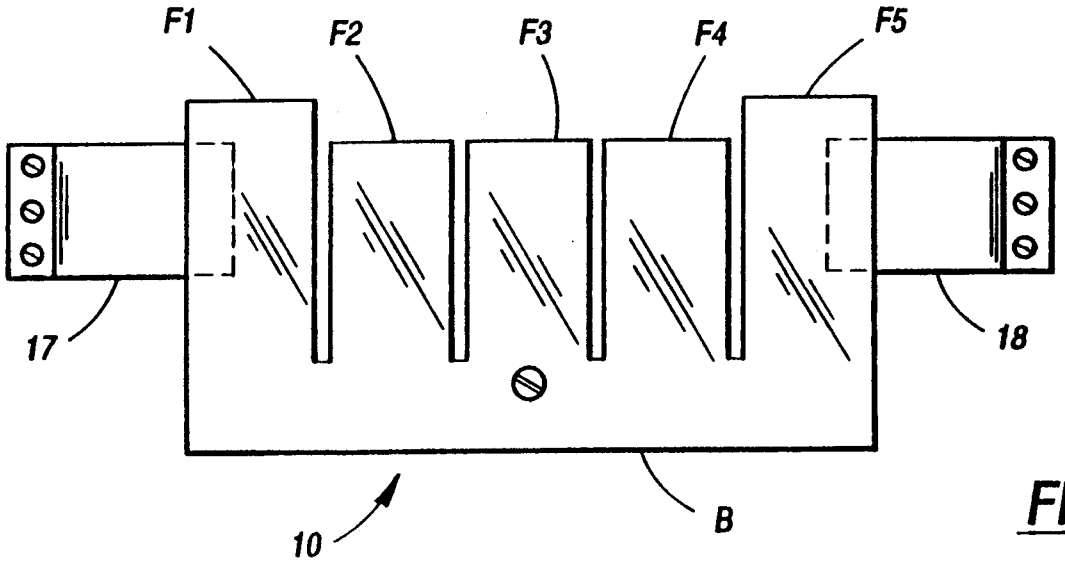
FIG. 4 is a front elevation view of a patch element and an associated pair of chokes using an alternative design.
Figure 5:
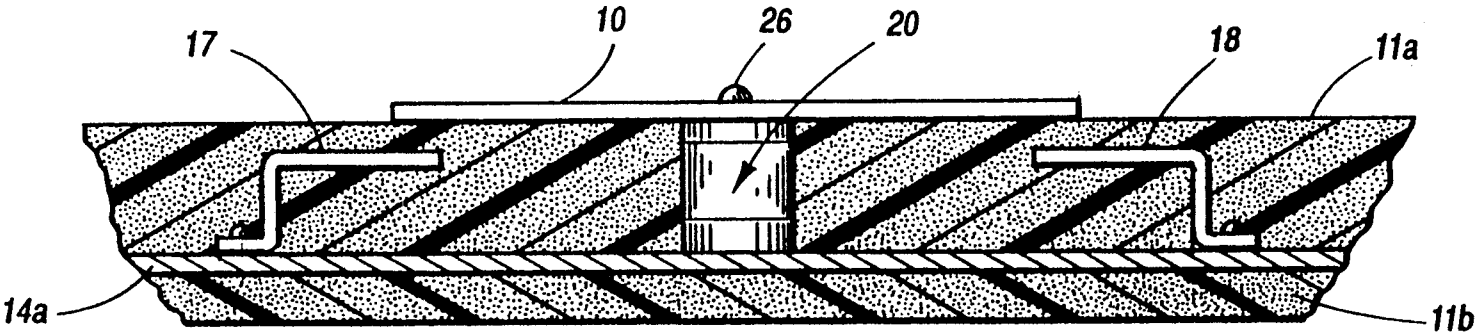
FIG. 5 is a bottom elevation taken from the left-hand side of FIG. 4.

An alternative choke arrangement is illustrated in FIGS. 4 and 5. In this arrangement a pair of chokes 17 and 18 are located on opposite sides of a radiating patch 10, with the free ends of the chokes overlapping the lateral edges of the pitch.

For the purpose of exciting the radiating patch elements 10*a*–10*f*, a stripline distribution network 19 is provided within that portion of the substrate 11 between the two ground planes 14*a* and 14*b*, i.e., between substrate layers 11*b* and 11*c*. This distribution network 19 is centrally supported on both sides by the rigid dielectric foam which forms the substrate. The foam layers 11*b* and 11*c* may be two separate layers of foam of equal thickness, e.g., about 5 mm. each. The input of the distribution network 19 is connected to the center conductor of a conventional N-type connector 19*a* mounted on the rear panel 12. The network 19 distributes radio-frequency power to the feed points of the patch elements 10*a*–10*f* with a relative phase and amplitude to produce the desired electrical beam downtilt and sidelobe levels.

For example, to produce a pattern with side lobes 20dB below the main beam, and a main beam downtilt of 6°, the output powers (for a one-watt input) and phases, relative to the bottom element, may be as follows:

| Element | Amplitude (W) | Phase (deg) |
|---|---|---|
| 1 (bottom) | .0771 | 0.0 |
| 2 | .1592 | 26.3 |
| 3 | .2637 | 52.7 |
| 4 | .2637 | 79.0 |
| 5 | .1592 | 105.4 |
| 6 (top) | .0771 | 131.7 |

The "sector coverage" (azimuth or horizontal beamwidth) is controlled by the physical width (horizontal dimension) of the antenna. The wider the antenna the narrower the azimuth beamwidth.

In order to couple the distribution network 19 to the radiating patch elements 10*a*–10*f*, for the purpose of exciting the patches, six probes 20*a*–20*f* are embedded within the substrate 11. One of these probes is shown in detail in FIG. 3. The major component of the probe is a conductive metal cylinder 21 which is connected to the network 19 by means of a metal bolt 22 and a metal spacer 23. The bolt 22 is threaded into the spacer 23, and a threaded extension on the spacer 23 is threaded into the cylinder 21. The spacer 23 passes through the ground plane 14*a* and is insulated therefrom by a dielectric sleeve 24. To prevent the sleeve 24 from passing through the ground plane 14*a*, the rear portion of the sleeve forms a flange 24*a* which abuts the rear surface of the ground plane. Similarly, to prevent the metal spacer 23 from passing through the sleeve 24, and thus the ground plane 14*a*, the portion of the spacer 23 rearwardly of the sleeve 24 has a larger diameter than that portion of the spacer 23 which extends through the sleeve 24. The resulting shoulder on the spacer 23 abuts the dielectric sleeve 24.

To facilitate electrical matching and to reduce assembly problems, the rear portion of the metal cylinder 21 is stepped inwardly so that the diameter at the input end of the cylinder matches that of the metal spacer 23. A dielectric sleeve 27 is disposed around the reduced-diameter portion of the cylinder 21 to abut with the dielectric sleeve 24 when the bolt 22 is tightened. It will be noted that this arrangement rigidly attaches the probe feed to the ground plane 14*a*.

The forward end of the metal cylinder 21 is spaced away from the radiating patch element 10*b* so that the probe is not in direct electrical contact with the patch element, but is coupled to the patch element by the field in the space between the probe and the patch element. The gap between the forward end of the cylinder 21 and the inside surface of the patch element 10*b* is filled with a dielectric spacer 25 which maintains a constant gap between the cylinder 21 and the patch element 10*b*. To hold the patch element 10*b* firmly in position against the substrate 11 and the spacer 25, a dielectric bolt 26 is passed through the patch element 10*b* and the dielectric spacer 25 and threaded into a tapped hole in the forward end of the metal cylinder 21.

The feed arrangement described above provides the antenna with the desired broad bandwidth by spacing the radiating patch elements 10 a substantial distance away from the ground place 14*a*. The bandwidth generally increases as this distance is increased, and the distance should be great enough to provide a bandwidth of at least 10%, and preferably at least 15%. Attainment of these bandwidths generally requires that the patch elements be spaced from the ground plane by at least 0.1 λ at the center frequency of the operating band.

One of the advantages of the antenna of this invention is the ease with which it can be assembled. For example a typical sequence of assembly steps is as follows:

1. The connector 19*a* is attached to the rear surface of the ground plane 14*b*.
2. The foam layer 11*c* is placed on the front surface of the ground plane 14*b*.
3. The metal spacers 23 are attached to the distribution network 19 by the bolts 22, and the resulting subassembly is placed on the front surface of the foam layer 11*c*.
4. The input to the network 19 is soldered to the inner conductor of the connector 19*a*.
5. The foam layer 11*b* is placed on the front surface of the stripline feed network subassembly, using the metal spacers 23 to properly locate the foam layer 11*b* onto the distribution network.
6. The dielectric sleeves 24 are placed on the metal spacers 23.
7. The common ground plane 14*a* is placed on the front surface of the foam layer 11*b*, with preformed holes in the ground plane 14*a* receiving the dielectric sleeves 24.
8. The metal probes 21, including the dielectric sleeves 27, are threaded onto the threaded extensions of the spacer 23 which protrude through the dielectric sleeves 24 located in the ground plane 14*a*.
9. The foam layer forming the substrate layer 11*a* is placed on the front surface of the common ground plane 14*a*, with preformed holes in the foam layer receiving the probes 21.
10. The dielectric spacers 25 are placed on the front ends of the probes 21, and then the patch elements 10*a*–10*f* are fastened to the respective probes 21 by means of the dielectric bolts 26.

The laminated subassembly comprising the two ground planes 14*a* and 14*b*, and all the members between those two ground planes, may be held together by a plurality of rivets (not shown). If desired, rigid spacers may be located between the two ground planes 14*a* and 14*b* to ensure that the distance between the two ground planes remains constant. The substrate layer 11*c* that supports the patch elements 10*a*–10*f* may also be adhesively bonded to the common ground plane 14*a*. Alternatively, that portion of the substrate may be held in position by the feed probes and the pressure excited by the patch elements 10*a*–10*f* attached to the feed probe.

The illustrative antenna has been demonstrated to have a bandwidth, more than ample for handling both the analog and the digital frequency bands of typical cellular telephone systems. One example of such an antenna that is capable of operating over the 824 to 960 MHz frequency band has a substrate having a thickness of 45 mm between the patch elements 10*a*–10*f* and the ground plane 14*a*, and an overall size of 1490 mm high by 390 mm wide by 98 mm deep. The probe diameter is 20 mm, and the spacing between the ground planes is 10 mm. This antenna provides the required gain (typically a minimum of 13 dBd gain), a cross-pol level that is 10 to 15 dB down over the entire operational handwidth, and good E- and H-plane radiation pattern integrity over the entire operational bandwidth.

We claim:

1. A patch antenna for transmitting and receiving microwave signals having a desired polarization, said antenna comprising:

a dielectric substrate, a plurality of radiating patches on said substrate, each radiating patch including a plurality of edges and a plurality of spaced non-radiating slots which are open at one end along only a single edge of said radiating patch to suppress the radiation of energy that is polarized in a direction transverse to the direction of the desired polarization, a distribution network for transmitting and receiving signals within said antenna, and a plurality of probes within said substrate for coupling said radiating patches and said distribution network, one end of each probe being connected to said distribution network, and the other end of each probe being coupled to one of said radiating patches.

2. The patch antenna of claim 1 wherein said slots are oriented vertically.

3. The patch antenna of claim 1 wherein each of said patches has a base portion that is coupled to said probe, and said slots do not extend into said base portion.

4. A patch antenna for transmitting and receiving microwave signals having a desired polarization, said antenna comprising:

a dielectric substrate, a plurality of radiating patches on said substrate, each radiating patch including at least four spaced non-radiating slots which are open at one end to suppress the radiation of energy that is polarized in a direction transverse to the direction of the desired polarization, the portions of each patch that are outboard of the endmost slots are longer than the portions of the patch that are inboard of the endmost slots.

a distribution network for transmitting and receiving signals within said antenna, and a plurality of probes within said substrate for coupling said radiating patches and said distribution network, one end of each probe being connected to said distribution network, and the other end of each probe being coupled to one of said radiating patches.

5. The patch antenna of claim 4 wherein the length of said outboard portions of each patch relative to the portions are selected to produce a desired beam width.

6. The patch antenna of claim 1 which includes a ground plane supported by said substrate in generally parallel and spaced relationship to said patches.

7. The patch antenna of claim 6 which includes a plurality of chokes connected to said ground plane and associated with said patches to suppress the radiation of energy that is polarized in a direction transverse to the direction of the desired polarization.

8. The patch antenna of claim 7 wherein a pair of said chokes are located on opposite sides of each of said patches.

9. The patch antenna of claim 6 wherein said patches and said distribution network are located on opposite sides of said ground plane.

10. The patch antenna of claim 6 wherein said probe includes an electrically conductive cylinder whose axis is perpendicular to the plane of said patches, and a dielectric sleeve separating said cylinder from said ground plane.

11. The patch antenna of claim 1 wherein said distribution network is a strip transmission line.

12. The patch antenna of claim 1 wherein a dielectric spacer is disposed in the space between said probe and said patches.

13. The patch antenna of claim 1 wherein said probe is wider at the patch end of the probe than at the distribution network end of the probe.

14. The patch antenna of claim 1 wherein said distribution network is embedded in said dielectric substrate.

15. A patch antenna for transmitting and receiving microwave signals having a desired polarization, said antenna comprising:

a dielectric substrate, a plurality of radiating patches on said substrate, a ground plane in generally parallel and spaced relationship to said patches, a plurality of chokes formed by conductive metal plates connected to said ground plane and not connected to said patches, said chokes suppressing ground-plane currents that would produce radiation of energy that is polarized in a direction transverse to the direction of the desired polarization, a distribution network for transmitting and receiving signals within said antenna, and a plurality of probes within said substrate for coupling said radiating patches and said distribution network, one end of each probe being connected to said distribution network, and the other end of each probe being coupled to one of said radiating patches.

* * * * *